US008073350B2

(12) United States Patent
Ishii et al.

(10) Patent No.: US 8,073,350 B2
(45) Date of Patent: Dec. 6, 2011

(54) DEVELOPING APPARATUS, IMAGE FORMING APPARATUS, AND PROCESS CARTRIDGE

(75) Inventors: Yasuyuki Ishii, Tokyo (JP); Hideki Kosugi, Kanagawa (JP); Tomoko Takahashi, Kanagawa (JP); Masaaki Yamada, Tokyo (JP); Ichiro Kadota, Kanagawa (JP); Yoshinori Nakagawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 523 days.

(21) Appl. No.: 12/140,032

(22) Filed: Jun. 16, 2008

(65) Prior Publication Data

US 2009/0035025 A1 Feb. 5, 2009

(30) Foreign Application Priority Data

Jul. 31, 2007 (JP) ..... 2007-200079

(51) Int. Cl.
*G03G 15/08* (2006.01)

(52) U.S. Cl. ..... 399/55; 399/266; 399/291

(58) Field of Classification Search ..... 399/55, 399/266, 284, 285, 289, 290, 291; 430/123.2
See application file for complete search history.

(56) References Cited

U.S. PATENT DOCUMENTS

| | | | | |
|---|---|---|---|---|
| 4,515,106 | A * | 5/1985 | Kohyama | 399/285 |
| 5,245,391 | A * | 9/1993 | Suzuki et al. | 399/285 |
| 5,923,930 | A | 7/1999 | Tsukamoto et al. | |
| 6,115,576 | A | 9/2000 | Nakano et al. | |
| 6,347,212 | B1 | 2/2002 | Kosugi et al. | |
| 6,422,696 | B1 | 7/2002 | Takahashi et al. | |
| 6,460,973 | B1 | 10/2002 | Takahashi et al. | |
| 6,623,816 | B1 | 9/2003 | Tanikawa et al. | |
| 6,658,227 | B2 | 12/2003 | Oyama et al. | |
| 6,684,047 | B2 * | 1/2004 | Kin et al. | 399/284 |
| 6,736,500 | B2 | 5/2004 | Takahashi et al. | |
| 7,308,222 | B2 | 12/2007 | Nakagawa et al. | |
| 7,313,336 | B2 | 12/2007 | Kadota et al. | |
| 7,340,204 | B2 | 3/2008 | Nakazato et al. | |
| 7,734,233 | B2 * | 6/2010 | Aoki et al. | 399/266 |
| 2006/0216071 | A1 | 9/2006 | Yamada et al. | |
| 2006/0251449 | A1 | 11/2006 | Takahashi et al. | |
| 2007/0013924 | A1 | 1/2007 | Sakai et al. | |
| 2007/0015071 | A1 | 1/2007 | Tsukamoto et al. | |
| 2007/0025775 | A1 | 2/2007 | Takahashi et al. | |
| 2007/0086811 | A1 | 4/2007 | Tsukamoto et al. | |
| 2007/0212121 | A1 | 9/2007 | Takahashi et al. | |
| 2007/0242985 | A1 | 10/2007 | Aoki et al. | |
| 2008/0089720 | A1 * | 4/2008 | Tsukamoto et al. | 399/260 |

(Continued)

FOREIGN PATENT DOCUMENTS

JP 3-21967 1/1991

(Continued)

*Primary Examiner* — Robert Beatty
(74) *Attorney, Agent, or Firm* — Oblon, Spivak, McClelland, Maier & Neustadt, L.L.P.

(57) ABSTRACT

A disclosed developing apparatus employs a flare roller that is a toner carrier in which electrodes of two different phases are provided at fine intervals. Density irregularities or scumming in a developed image due to a potential difference between the flare roller and a latent image carrier are prevented by maintaining a constant potential on the flare roller surface. A voltage is applied to the electrodes on the flare roller such that an electric field that varies with time is generated between the electrodes, whereby a toner cloud is produced by the movement or hopping of toner over the flare roller. Thereby the toner attaches to a latent image on the latent image carrier, thus developing the latent image. In one embodiment, a bias with an average potential equal to an average potential of the bias applied to the electrodes is applied to a toner layer thickness regulating member.

20 Claims, 11 Drawing Sheets

U.S. PATENT DOCUMENTS

| | | | | |
|---|---|---|---|---|
| 2008/0124138 | A1 | 5/2008 | Kosugi et al. | |
| 2009/0022523 | A1 * | 1/2009 | Kadota et al. | 399/266 |

FOREIGN PATENT DOCUMENTS

| | | | |
|---|---|---|---|
| JP | 3-100575 | | 4/1991 |
| JP | 3-113474 | | 5/1991 |
| JP | 03260676 | A * | 11/1991 |
| JP | 9-269661 | | 10/1997 |
| JP | 2002-341656 | | 11/2002 |
| JP | 2003-15419 | | 1/2003 |
| JP | 2003-84560 | | 3/2003 |
| JP | 2004-286837 | | 10/2004 |

* cited by examiner

DEVELOPING APPARATUS, IMAGE FORMING APPARATUS, AND PROCESS CARTRIDGE

BACKGROUND OF THE INVENTION

1. Field of the Invention

The present invention generally relates to the development of an electrostatic latent image on a latent image carrier in electrophotographic systems. More specifically, the invention relates to a cloud development method whereby a toner cloud is electrically produced.

2. Description of the Related Art

A developing unit used in a conventional image forming apparatus, such as a copy machine, a printer, or a FAX machine, may employ a two-component developing method or a one-component developing method. The two-component developing method is suitable for high-speed development, and is employed in the majority of the current middle- to high-speed image forming apparatuses.

In the two-component developing method, in order to achieve a high image quality, it is necessary to make the developer, which typically consists of a toner formulation and magnetic material called a carrier, very fine and dense at the point where the developer comes into contact with an electrostatic latent image on the latent image carrier. For this purpose, the carrier particles dots of high-resolution. In this method, a wire to which a high-frequency bias is applied is disposed at the development portion, whereby a toner cloud is produced at the development portion with which to realize high-resolution dot development characteristics.

Japanese Laid-Open Patent Application No. 3-21967 discloses a method of forming an electric field curtain over a rotating roller in order to form a toner cloud stably and efficiently.

Japanese Laid-Open Patent Application No. 2003-15419 discloses a developing apparatus in which the developer is transported by an electric field curtain based on a traveling-wave electric field.

Japanese Laid-Open Patent Application No. 9-269661 discloses a developing apparatus having plural magnetic poles that cause a substantially single carrier layer to be substantially uniformly adsorbed on the peripheral surface of the developing roller.

Japanese Laid-Open Patent Application No. 2003-84560 discloses a developing apparatus in which electrodes are disposed on the surface of a developer carrier at regular intervals interposed with insulating portions. Predetermined bias potentials are applied to the electrodes in order to produce an electric field gradient near the developer carrier surface, causing a nonmagnetic toner to become attached to the developer carrier for transportation.

In connection with the two-component developing method, there is an increasing demand for higher image quality. To meet such a demand, the pixel dot size needs to be equal to or smaller than the current carrier particle sizes. Thus, it is necessary to make the carrier particles smaller from the viewpoint of individual dot reproducibility.

However, as the carrier size is reduced, the permeability of the carrier particle decreases, which causes the carrier to be more readily separated from the developing roller. If a separated carrier particle attaches to the latent image carrier, not only the image is made deficient by the attaching of the carrier particle per se, but also various other side effects may be caused, including the potential of the attached particle to damage the latent image carrier.

In order to prevent such carrier separation, various attempts have been made. One is the attempt to increase the permeability of the carrier particle from a material aspect. Another attempt has been to increase the magnetic force of the magnets contained in the developing roller. However, development of a suitable material for the magnets with increased magnetic force has been very difficult due to the need to balance cost reduction and image quality.

Furthermore, the size of the developing roller is becoming increasingly smaller due to the continuing demand for ever smaller sizes of equipment, making it more difficult to design a developing roller with a strong magnetic field configuration such that carrier separation can be completely prevented.

Because the two-component developing method inherently involves a process of forming a toner image by rubbing bristles of a two-component developer, called a magnetic brush, against an electrostatic latent image, the development characteristics of individual dots tend to become uneven due to the unevenness in the bristles.

While improved image quality may be obtained by forming an alternating electric field between the developing roller and the latent image carrier, the fundamental image unevenness due to the irregularities inherent in the developer cannot be completely eliminated.

In the one-component developing method, during the process of reducing the thickness of the toner layer on the developing roller by the toner regulating member, the toner is pressed against the developing roller rather strongly. As a result, the toner responds to an electric field at the development portion very poorly. Thus, normally, in order to obtain a high image quality, a strong alternating electric field is formed between the developing roller and the latent image carrier. However, even with such an alternating electric field, it is still difficult to develop the electrostatic latent image stably with a constant supply of toner. Thus, it has been difficult to develop high-resolution fine dots uniformly.

Another disadvantage of the one-component developing method is that the toner is subject to much stress during the formation of the toner thin-layer on the developing roller. As a result, the toner, which is circulated in the developing unit, degrades fast. As the toner degrades, unevenness tends to occur also in the step of forming the toner thin-layer on the developing roller. Thus, the one-component developing method is not generally suitable for forming an image at high speed and with high durability.

Some of the aforementioned problems may be overcome by a hybrid method, although with an increase in the size of the developing unit or the number of its components. However, there still remains the same problem at the development portion as in the one-component developing method. Namely, it is still difficult to develop fine and uniform dots with high resolution.

While the aforementioned method of Japanese Laid-Open Patent Application No. 3-113474 may be capable of realizing a stable and high-quality image development, the structure of the developing unit used is complicated.

The aforementioned method of Japanese Laid-Open Patent Application No. 3-21967 may be capable of reducing the size of equipment and achieving high-quality development. However, a study conducted by the present inventors showed that with this method, various conditions relating to the electric field curtain and development need to be strictly limited in order to obtain an ideal image quality. If an image is formed under inappropriate conditions, no intended effects are obtained and indeed a poorer quality image may result.

In an image forming process in which a first toner image is formed on the latent image carrier and then a second, and a third toner images are formed sequentially thereon, the toner image that is previously formed must not be disturbed. The contactless one-component developing method or the aforementioned toner cloud development method according to Japanese Laid-Open Patent Application No. 3-113474 are capable of forming a toner image of an individual color on the latent image carrier sequentially. However, in all of these methods, because an alternating electric field is formed between the latent image carrier and the developing roller, part of the toner may be peeled from the toner image previously formed on the latent image carrier and enter into the developing unit. As a result, not only the image on the latent image carrier is disturbed but also the toners of various colors may become mixed in the developing unit. This may be fatal for achieving a high-quality image. In order to overcome this problem, a development method is required that does not involve the formation of an alternating electric field between the latent image carrier and the developing roller.

While such a method may be realized with the aforementioned cloud development method of Japanese Laid-Open Patent Application No. 3-21967, this method requires strictly limited conditions to achieve intended effects, as mentioned above.

Japanese Laid-Open Patent Application No. 2002-341656 teaches a method whereby a toner is electrostatically transported by alternating electric fields of three or more phases while eliminating any mechanical driving of the toner carrier. In this method, however, the toner may accumulate on the transport substrate starting with the toner whose electrostatic transport has been terminated for one reason or another. While a structure to overcome this problem has been proposed by Japanese Laid-Open Patent Application No. 2004-286837, for example, which is based on a combination of a fixed transport substrate and a toner carrier that moves on the surface thereof, the mechanism involved is very complex.

In order to solve this problem, the present inventors have proposed a method whereby an electric field that changes periodically with time is produced between electrodes of two phases, causing the toner to move or hop away from the rotating toner carrier while the toner is carried to an area opposite the latent image carrier where the latent image is developed.

In this method, instead of the conventional one-component developing roller, electrodes of two phases are embedded in a roller (to be hereafter referred to as a flare roller) at fine pitches, and the toner is caused to move or hop over the roller surface. The electrodes are covered with an insulating surface protection layer.

A study conducted by the present inventors, however, showed that when the flare roller is rotated, the surface potential of the flare roller greatly varies for various reasons, such as the triboelectric charging between the toner layer thickness regulating member and the roller, the triboelectric charging between the hopping toner and the roller, and the injection of charge into the flare roller surface by the potential difference between an average bias applied to the supply roller and an average bias applied to the flare roller.

Consequently, at the portion opposite the latent image carrier, the potential difference between the flare roller surface and an image portion or a non-image portion of the latent image carrier may fluctuate, resulting in image density irregularities and/or scumming.

SUMMARY OF THE INVENTION

It is therefore a general object of the invention to overcome the aforementioned problems of the related art. A more specific object is to provide a developing apparatus, an image forming apparatus, and a process cartridge in which, instead of a one-component developing roller, a flare roller having electrodes of two different phases disposed at small intervals is used as a toner carrier, whereby the aforementioned image density irregularities or scumming that is caused by a potential difference is prevented by maintaining a constant potential at the flare roller surface.

In one aspect, the invention provides a developing apparatus comprising a toner carrier having plural electrodes disposed at predetermined intervals; and a first voltage supply unit configured to apply a bias voltage to the electrodes of the toner carrier in order to generate an electric field between the electrodes that varies with time. Toner carried on the surface of the toner carrier is caused to hop by the electric field between the electrodes, forming a cloud of toner so that the toner attaches to a latent image formed on a latent image carrier which is disposed opposite the toner carrier, thereby developing the latent image. The apparatus further includes a toner layer thickness regulating member configured to regulate the amount of the toner that is carried on the toner carrier; and a second voltage supply unit configured to apply a bias voltage to the toner layer thickness regulating member. The bias voltage applied to the toner layer thickness regulating member has an average value that is equal to an average value of the bias voltage applied to the electrodes of the toner carrier by the first voltage supply unit.

In a preferred embodiment, the bias voltage applied to the electrodes of the toner carrier includes a bias voltage having a waveform that varies with time that is applied to one group of the electrodes, and another bias voltage having a waveform that varies with time with an opposite phase that is applied to another group of the electrodes. The bias voltage applied to the toner layer thickness regulating member is a DC bias voltage.

In another preferred embodiment, the bias voltage applied to the electrodes of the toner carrier includes a bias voltage having a waveform that varies with time that is applied to one group of the electrodes, and a DC bias voltage that is applied to another group of the electrodes. The bias voltage applied to the toner layer thickness regulating member is a DC bias voltage.

In another preferred embodiment, the bias voltage applied to the electrodes of the toner carrier includes a bias voltage having a waveform that varies with time that is applied to one group of the electrodes, and a bias voltage having a waveform that varies with time with an opposite phase that is applied to another group of the electrodes. The bias voltage applied to the toner layer thickness regulating member has a waveform that varies with time.

In another preferred embodiment, the bias voltage applied to the toner layer thickness regulating member is equal to the bias voltage applied to the one group of the electrodes of the toner carrier.

In another preferred embodiment, the bias voltage applied to the electrodes of the toner carrier includes a bias voltage having a waveform that varies with time that is applied to one group of the electrodes, and a DC bias voltage applied to another group of the electrodes. The bias voltage applied to the toner layer thickness regulating member has the same waveform as the waveform of the bias voltage applied to the one group of the electrodes of the toner carrier.

In another preferred embodiment, the toner layer thickness regulating member has electrical conductivity.

In another aspect, the invention provides an image forming apparatus comprising a latent image carrier on which a latent image is carried; the aforementioned developing unit; an image transfer unit; and a recording medium. The latent image carried on the latent image carrier is developed by causing the toner on the toner carrier in the developing unit to become attached to the latent image. The developed image is transferred onto the recording medium by the image transfer unit.

In a preferred embodiment, the image forming apparatus comprises a plurality of the developing apparatuses. Each of the developing apparatuses is configured to develop the latent image on the latent image carrier with a toner of a separate color so that a multicolor image can be formed on the latent image carrier.

In another aspect, the invention provides a process cartridge comprising the aforementioned developing apparatus; and at least one of a latent image carrier on which a latent image is carried, a charging unit configured to charge the latent image, and a cleaning unit configured to remove the toner that remains on the latent image carrier after the latent image on the image carrier is developed and transferred to a recording medium.

In a preferred embodiment, the developing apparatus is configured to develop the latent image on the latent image carrier with a toner of an individual color so that a multicolor image can be formed on the recording medium by a plurality of the process cartridges used in combination.

In accordance with the various embodiments of the present invention, a constant surface potential can be obtained over the toner carrier as the toner passes the development nip region while the flare roller is activated (to cause toner hopping). Thus, a constant potential difference can be achieved with respect to an image portion and a non-image portion of the electrostatic latent image on the photosensitive member, whereby a good image having no image density irregularities can be obtained.

BRIEF DESCRIPTION OF THE DRAWINGS

Other objects, features and advantages of the present invention will become apparent upon consideration of the specification and the appendant drawings, in which.

DETAILED DESCRIPTION OF THE PREFERRED EMBODIMENTS

In the following, the present invention is described by way of embodiments with reference made to the drawings.

Figure 1:
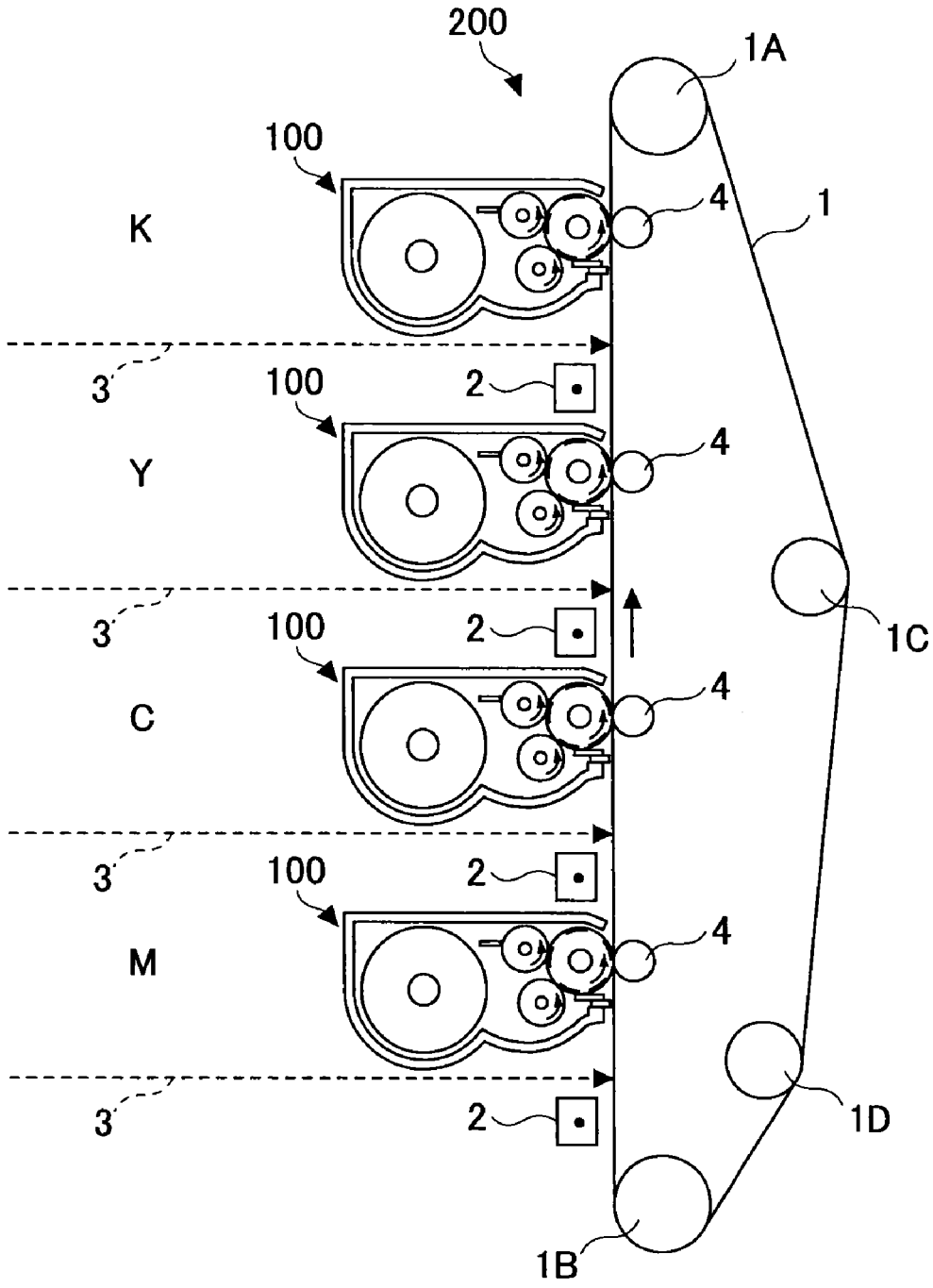
FIG. 1 schematically shows an image forming apparatus employing plural developing units according to an embodiment of the invention.
Figure 2:
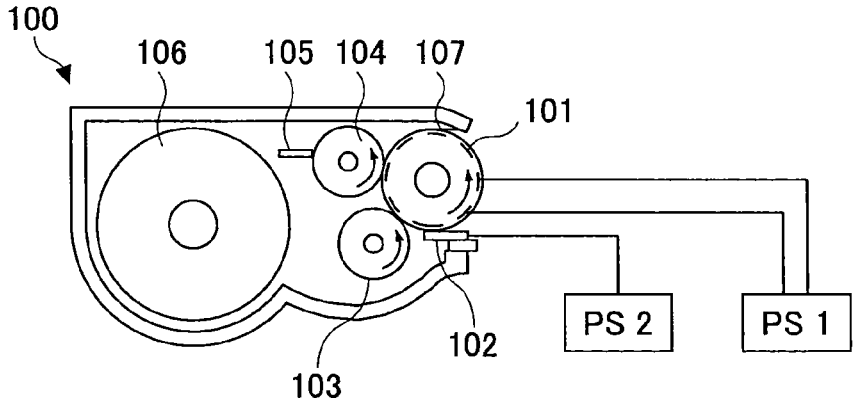
FIG. 2 schematically shows a developing unit used in the image forming apparatus shown in FIG. 1.

FIG. 1 shows an image forming apparatus 200 according to an embodiment of the present invention. The image forming apparatus 200 includes plural developing units 100 of the flare type shown in FIG. 2. In the image forming apparatus 200, a toner image of an individual color is formed on a photosensitive member 1, which is a latent image carrier, one color upon another. A flare developing method is described in detail later.

The photosensitive member 1, which is belt-shaped, is extended on plural rollers 1A to 1D and is rotated in the direction indicated by an arrow by a drive unit (not shown). For the sake of description, the individual developing units 100 for different colors are designated by K (black), Y (yellow), C (cyan), and M (magenta).

The plural developing units 100 for forming images of the multiple colors black, yellow, cyan, and magenta are arranged opposite the photosensitive member 1. The photosensitive member 1 is initially charged uniformly by a charging device 2 associated with the developing unit (M) 100. The charged photosensitive member 1 is then exposed with a light beam 3 from a writing device, not shown, as an exposing unit, which light beam is modulated with magenta image data. An electrostatic latent image is thus formed and then developed by the developing unit (M) 100, forming a magenta toner image. The photosensitive member 1 is then neutralized by a neutralizer (not shown) to prepare for the next round of image formation.

The photosensitive member 1 is then uniformly charged by the charging device 2 associated with the developing unit 100 for the color cyan and exposed with a light beam 3 modulated with cyan image data from another writing device, not shown. An electrostatic latent image is thus formed and is developed by the developing unit (C) 100, producing a cyan toner image superposed on the magenta toner image. Thereafter, the photosensitive member 1 is again neutralized by another neutralizer which is not shown to prepare for the next image formation.

The photosensitive member 1 is then charged by the next charging device 2 uniformly and exposed to a light beam 3 modulated with yellow image data from the writing device, not shown, thus forming an electrostatic latent image which is developed by the developing unit (Y) 100, producing a yellow toner image superposed over the magenta and cyan toner images. Thereafter the photosensitive member 1 is again neutralized by a neutralizer which is not shown to prepare for the next image formation.

Finally, the photosensitive member 1 is uniformly charged by the next charging device 2 and then exposed to a light beam 3 modulated with black image data from the writing device (not shown). An electrostatic latent image thus formed is developed by the developing unit (K) 100, forming a black toner image superposed over the magenta, cyan, and yellow toner images, thus forming a full-color image.

Meanwhile, a recording medium such as a recording paper is fed from a feeding device (not shown). Onto the recording medium, the full-color image on the photosensitive member 1 is transferred via a transfer roller 4 to which a transfer bias is applied from a power supply. After the full-color image is fixed on the recording medium by a fusing device, the recording medium is discharged to the outside. After the transfer of the full-color image, the remaining toner and the like on the photosensitive member 1 is removed by a cleaning unit (not shown).

In the foregoing embodiment, because the four colors are written on the same photosensitive member, substantially no position error occurs in principle compared to a conventional four-drum tandem system. Thus, separate colors can be superposed on the photosensitive member and a high-quality full-color image having no position error can be obtained. Furthermore, in the above multicolor system based on the developing apparatus of the present embodiment, because the toner carrier in each of the developing units 100 does not come into contact with the photosensitive member, and no alternating electric fields are applied in the development region, the development step for the next color does not affect, either mechanically or in terms of an electric field, the toner image that has previously been formed on the photosensitive member. Thus, a high-quality image forming process can be conducted stably for a long time without the problems of scavenging or color mixing.

In the following, the flare development in the developing unit is described.

Figure 3:
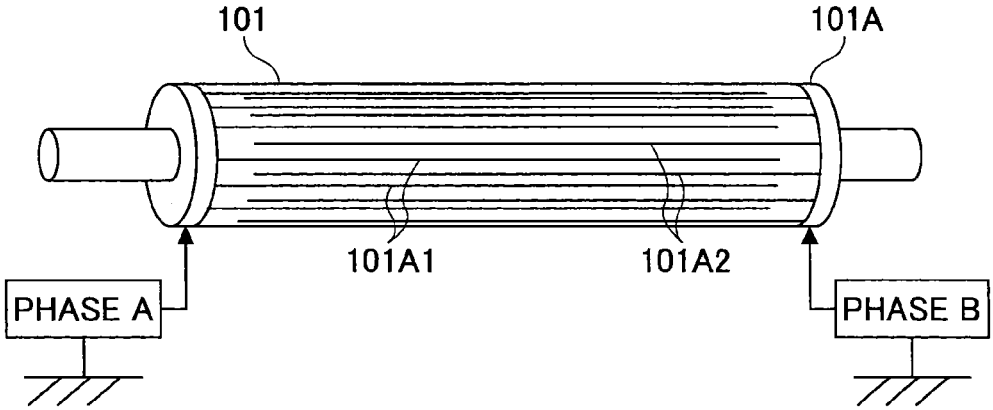
FIG. 3 is a perspective view of a flare roller in the developing unit shown in FIG. 2.
Figure 4:
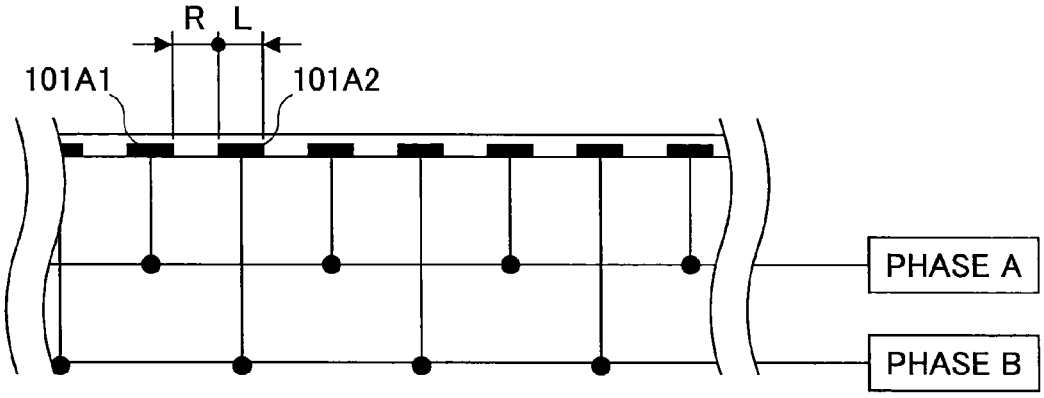
FIG. 4 schematically shows an electrode structure of the flare roller shown in FIG. 3.

FIG. 3 schematically depicts a flare roller 101. FIG. 4 schematically shows a cross section of the surface of the flare roller 101 taken perpendicular to the axis of the roller, depicted in a flattened manner for the sake of description.

On a support substrate 101A, electrodes 101A1 and 101A2 are disposed at predetermined intervals. A surface protection layer of inorganic or organic insulating material is layered on the electrodes 101A1 and 101A2. In FIG. 4, the lines extending from each electrode indicate conductive leads for applying a voltage to each electrode. Of the intersections of the lines, only those points indicated by dots are electrically connected, and other portions are electrically insulated from each other. To the electrodes, drive voltages of two different phases are applied from a power supply PS1.

Figure 5:
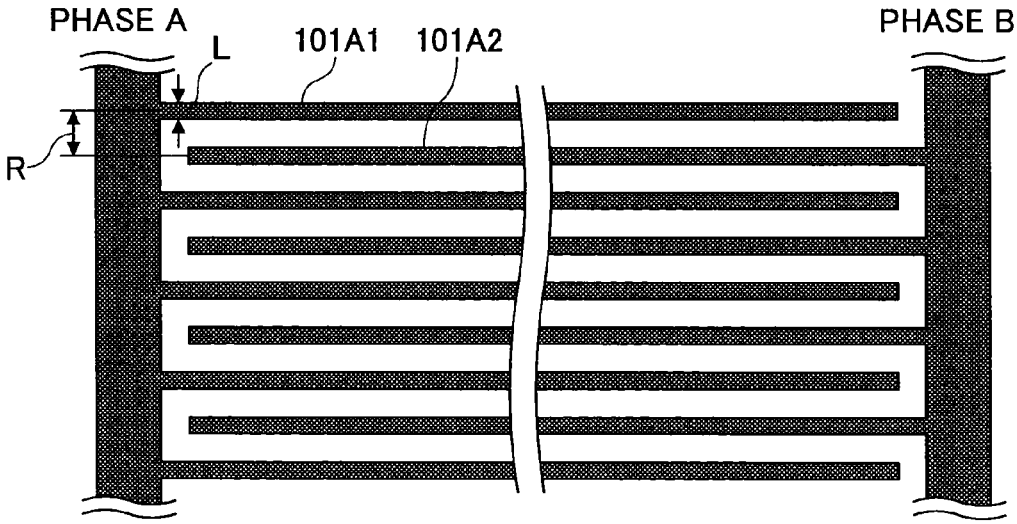
FIG. 5 shows an expanded plan view of the electrode structure of FIG. 4.

FIG. 5 shows an expansion plan of the flare roller electrode portion. As shown, the flare roller 101 includes the electrodes of two phases A and B for producing electric fields with which to cause the toner to hop. To even-numbered electrodes and odd-numbered groups of electrodes are applied drive waveforms of opposite phases, such as shown in FIG. 6B, from a drive circuit (not shown), whereby a potential difference is caused between the two phases of electrodes at certain temporal periods.

The odd-numbered electrodes are connected to one end and the even-numbered electrodes are connected to the other end of the rotating shaft of the flare roller 101.

Referring back to FIG. 2, the developing unit 100 includes the flare roller 101, which is the toner carrier, opposite which the photosensitive member 1 is disposed in a non-contact manner; a toner layer thickness regulating member 102 for defining the thickness of a developer (toner) layer carried on the flare roller 101; a supply roller 103 for supplying a developer (toner) to the flare roller 101; a collection roller 104 for collecting the remaining developer on the surface of the flare roller 101 past the position opposite the photosensitive member 1; a flicker 105 for flicking the developer off the collection roller 104; and a developer stirring paddle 106. Numeral 107 designates a toner leakage preventing member consisting of a sealing member or the like.

In the developing unit 100, the toner is stirred by the stirring paddle 106 and then supplied via the supply roller 103 to the flare roller 101. The toner then moves or hops in accordance with the periodically changing electric field applied as described above. As the flare roller 101 rotates, the toner is transported to the developing region opposite the photosensitive member 1, where the toner moves toward and becomes attached to a latent image on the photosensitive member 1 on account of the force of the electric field, thus developing the latent image.

The toner that does not contribute to development passes the toner leakage preventing member 107 and is transported to a region opposite the collection roller 104. Because the toner on the flare roller 101 is hopping, the attraction between the toner and the flare roller 101 is very weak and therefore can be easily collected by the collection roller 104. In a region where the supply roller 103 and the flare roller 101 are opposite to each other, new toner is supplied to the flare roller 101. This process is repeated such that a constant amount of toner is hopping over the flare roller 101 at all times.

Examples of the support substrate of the flare roller 101 include a substrate made of insulating material, such as a glass substrate, a resin substrate, and a ceramic substrate; a substrate made of a conductive material such as SUS on which an insulating film of $SiO_2$ or the like is formed; and a substrate made of other material such as polyimide.

The electrodes are formed by forming a film of conductive material, such as Al or Ni—Cr, on the support substrate to a thickness of 0.1 to 10 μm, preferably from 0.5 to 2.0 μm, and then patterning it by photolithography or the like into a required electrode shape.

In the following, a description is given of the electrode width L and the electrode interval R on the flare roller for causing toner hopping. Drive waveforms and a surface protection layer are also described. The electrode width L and the electrode interval R of the transport member, i.e., the flare roller 101, greatly affect the toner hopping efficiency. The electrode pitch P is expressed by P=R+L.

The toner that exists between the electrodes moves on the substrate surface to an adjacent electrode on account of an electric field in a substantially horizontal direction. On the other hand, most of the toner on top of the electrodes leaves the substrate surface and hops because it is given an initial velocity that has a vertical component.

Particularly, the toner that is at or around the edge of an electrode jumps across the adjacent electrode. Thus, when the electrode width L is large, the number of toner particles that are on top of a particular electrode increases, and correspondingly the number of toner particles that have large travel distances increases. However, if the electrode width L is too large, the field intensity at or around the center of each electrode decreases, whereby the toner tends to remain attached to the electrode and the hopping rate decreases. The present inventors found through a study that there is an appropriate electrode width at which the toner can be caused to hop efficiently at a low voltage.

The electrode interval R determines the field intensity between the electrodes based on the relationship between distance and applied voltage. The smaller the interval R, naturally the greater the field intensity, so that a hopping initial velocity can be more easily obtained. However, this results in a shorter single-travel distance for the toner that moves from one electrode to another. Thus, the hopping time of such toner becomes shorter and the landing time becomes longer unless the drive frequency is increased.

The present inventors also conducted a study and experiments on this point, and found that there is an appropriate electrode interval for transporting toner and causing it to hop efficiently with a low voltage. They also found that the thickness of the surface protection layer on the electrode surface also affects the field intensity over the electrode surface, particularly the electric lines of force of the perpendicular component, determining the efficiency of hopping.

Namely, by setting an appropriate relationship among the electrode width, the electrode interval, and the surface protection layer thickness of the flare roller, efficient hopping can be performed with a low voltage.

Thus, in the present embodiment, the electrode width L shown in FIG. 4 is set within the range of from 1 to 20 times the average particle size of toner, and the electrode interval R is set within the range of from 1 to 20 times the average particle size of the toner.

The surface protection layer may be formed of $SiO_2$, $BaTiO_2$, $TiO_2$, $TiO_4$, SiON, BN, TiN, or $Ta_2O_5$. The thickness may be in the range of from 0.5 to 10 μm and preferably from 0.5 to 3 μm.

The $SiO_2$ or the like may be coated with organic material such as polycarbonate. The coating material may be zirconia or other material conventionally used as a coating material for a two-component developer carrier, such as silicone resin. The surface protection layer is appropriately selected from the viewpoint of insulating property, durability, the method of manufacturing the flare roller, and its relationship with the toner used in terms of the triboelectric series.

The flare roller 101 of the developing unit 100 of the present embodiment used in the image forming apparatus 200 may be made out of a rectangular sheet measuring at least 21 cm×30 cm, on which the fine patterns for the electrodes are formed.

Hereafter, several methods of manufacturing the flare roller 101 are described.

In a first method, a flexible electrode pattern is formed and then wound on a support drum. In an example of a substrate having flexible, fine-pitch, and thin-layer electrodes, a base film (thickness 20-100 μm) of polyimide is used as a substrate on which a film of, e.g., Cu, Al, or Ni—Cr is formed to 0.1 to 0.3 μm thickness by vapor deposition. When the width is 30 to 60 cm, the pattern can be manufactured with roll-to-roll equipment, whereby enhanced mass-productivity can be achieved. With a common bus line, electrodes with widths of about 1 to 5 mm can be simultaneously formed.

Vapor deposition may be performed by sputtering, ion plating, CVD, or an ion beam process. When the electrodes are formed by sputtering, for example, a Cr film may be interposed to improve adhesion with polyimide. Adhesion may also be improved by plasma process or primer process.

Other than vapor deposition, electrodeposition may be used to form the thin-layer electrodes. In this case, electrodes are initially formed on the polyimide substrate by electroless plating. After forming base electrodes by dipping the substrate in tin chloride, palladium chloride, and nickel chloride successively, electrolytic plating is conducted in an Ni electrolyte, whereby an Ni film with a thickness of 1 to 3 μm can be manufactured by a roll-to-roll process.

The resultant thin-film electrodes are coated with a resist, patterned, and etched into required shapes. In this case, when the electrodes have a thickness in the range of 0.1 to 3 μm, fine pattern electrodes with widths or intervals on the order of 5 μm to 10 μm can be formed with high accuracy by photolithography and etching.

Thereafter, a surface protection layer of $SiO_2$, $BaTiO_2$, or $TiO_2$, e.g., is formed to a thickness of 0.5 to 2 μm by sputtering, for example. Alternatively, a surface protection layer of PI (polyimide) may be formed to a thickness of 2 to 5 μm using a roll coater or other coating device and then baked. If the sole PI layer is problematic, a $SiO_2$ film or other inorganic film may be formed thereon to a thickness of 0.1 to 0.5 μm by sputtering, for example. Further alternatively, a film of organic material such as polycarbonate may be coated on the $SiO_2$. It is also possible to use zirconia or other material that is conventionally used as a coating material for a two-component developer carrier, such as silicone resin.

The flexible substrate thus formed can be easily affixed to a cylindrical drum or made partly curved.

In another embodiment, a polyimide base film (thickness 20 to 100 μm) may be used as a substrate, on which an electrode material such as Cu or SUS may be formed to a thickness of 10 to 20 μm. In this case, conversely polyimide is applied to the metal material with a roll coater to a thickness of 20 to 100 μm and then baked. Then, the metal material is patterned by photolithography and etching into a desired shape of electrodes. The surface of the electrodes are coated with a protection layer of polyimide. By smoothing any surface irregularities corresponding to the thickness of 10 to 20 μm of the metal material electrode, the fine pattern electrodes can be completed.

For example, irregularities on the substrate can be smoothed by spin-coating the substrate with polyimide material or polyurethane material with a viscosity of 50 to 10,000 cps and preferably 100 to 300 cps and then allowing it to stand. In this way, the irregularities on the outer-most surface of the transport member can be smoothed by the surface tension of the coating material.

In another embodiment, the strength of the flexible substrate may be increased by using an SUS or A1 material in the substrate with a thickness of 20 to 30 μm, and coating its surface with an insulating layer (insulating the electrodes from the substrate) of diluted polyimide material to a thickness on the order of 5 μm, using a roll coater. The polyimide is pre-baked under the conditions of 150° C. for 30 minutes and then post-baked under the conditions of 350° C. for 60 minutes, thereby forming a thin-layer polyimide film and completing a support plate.

Thereafter, a plasma process or a primer process is performed to improve adhesion, followed by vapor-deposition of Ni—Cr to a thickness of 0.1 to 0.2 μm. The thin-layer electrode layer is then formed into the fine pattern electrode having the aforementioned thickness of several 10 μm, by photolithography and etching. The surface is further layered with the aforementioned surface protection layer 13 of $SiO_2$, $BaTiO_2$, or $TiO_2$ to a thickness of 0.5 to 1 μm by sputtering, thereby obtaining a flexible transport member. The layer of $SiO_2$ or the like may be coated with organic material such as polycarbonate. Zirconia or other material conventionally used as a two-component developer carrier coating material, such as silicone resin, may be selected.

In another method of manufacturing the flare roller, a cylindrical drum is patterned with electrodes and then coated with a surface protection layer, as shown in FIGS. 7A through 7E.

Through the steps shown in FIGS. 7A through 7E, a pattern electrode is formed. In these figures, a cylindrical drum 51 is shown in a planar manner for ease of understanding, with the axis of rotation of the cylindrical drum 51 extending perpendicular to the drawing sheet.

Figure 7A:
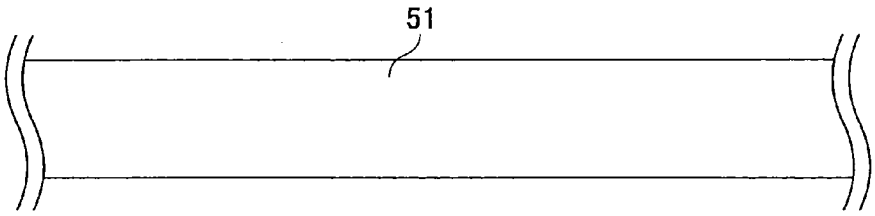
FIG. 7A shows a step of smoothing the surface of a drum material in a process of fabricating a flare roller.

In the step of FIG. 7A, the surface of the cylindrical drum 51 is smoothed by circumferential lathe turning.

Figure 7B:
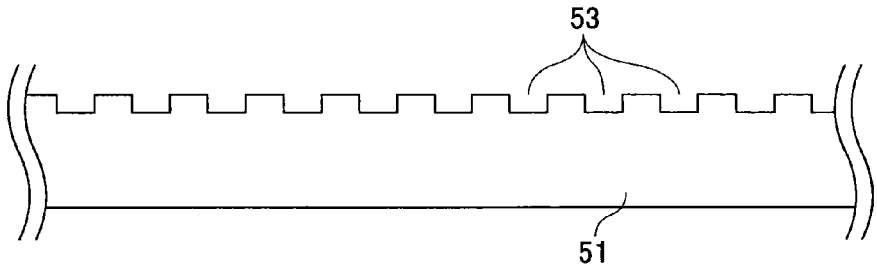
FIG. 7B shows a step of forming grooves in the surface of the drum material.
Figure 7C:
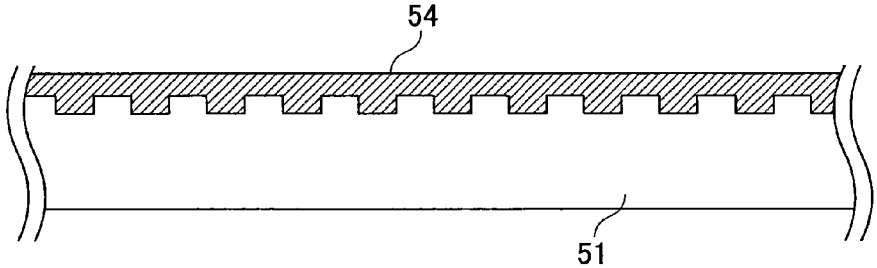
FIG. 7C shows a step of plating the surface of the drum material.
Figure 7D:
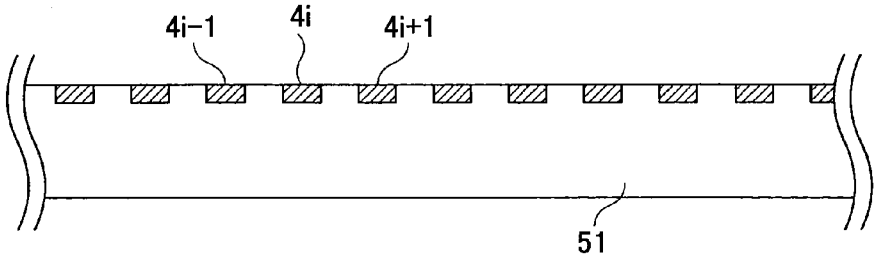
FIG. 7D shows a step of removing an unnecessary film on the surface of the drum material.
Figure 7E:
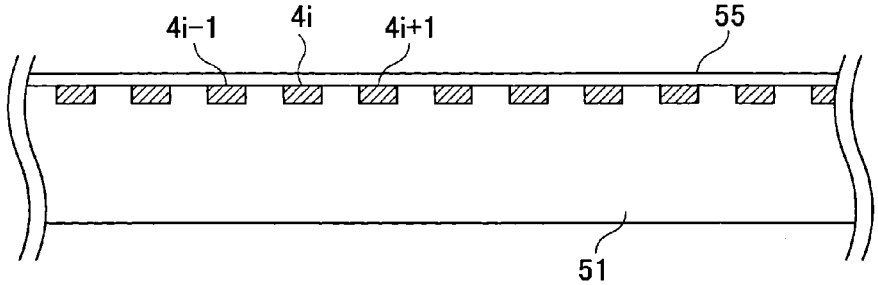
FIG. 7E shows a step of forming a surface protection layer.

In the step of FIG. 7B, grooves 53 with a width of 50 μm are cut at a pitch of 100 μm. In the step of FIG. 7C, the drum 51 with the grooves is plated with electroless nickel 54. In the step of FIG. 7D, the circumference of the cylindrical drum 51 is turned to remove unwanted conductor film.

At this point, electrodes 41, 42, 43, . . . and so on (indicated by "4*i*−1," "4*i*," and "4*i*+1" in FIG. 7) are formed in the grooves 53 in isolation from each other. The cylindrical drum 51 is then coated with silicone resin to smooth its surface. A surface protection layer 55 (with a thickness of about 5 μm and a volume resistivity of about $10^{10}$ Ω·cm) is also formed, thereby completing the toner carrier roller with the electrodes formed as shown in FIG. 5.

The flare roller may also be manufactured by a screen printing process using an electrically conductive ink, a printing process using an ink-jet technology, or a process involving the removal of a non-electrode portion of a plated electrode by a laser technology.

The method of fabricating an electrode pattern and a surface protection layer on the flare roller is not limited to the above-described methods. In other examples, silver or copper may be used as an electrode material.

EXAMPLE 1

Figure 10:
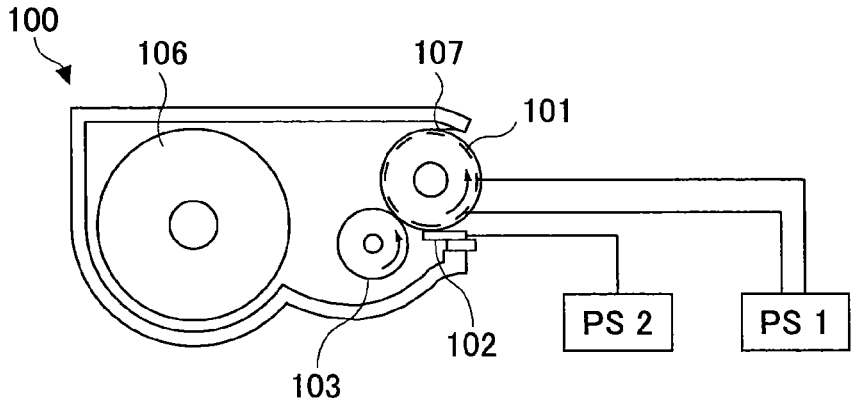
FIG. 10 shows a developing unit according to an embodiment of the present invention.

In Example 1, a developing unit shown in FIG. 10 was used.

A toner contained in a toner container portion of the developing unit 100 is conveyed by a stirring paddle 106 to a supply roller 103. By rotating the supply roller 103 in a direction opposite to the rotation of a flare roller 101, the supply roller 103 also functions as a collection roller. The supply/collection functions may be independently provided, as in the example shown in FIG. 2.

As the toner is supplied to the flare roller 101, the toner is triboelectrically charged. The toner is then conveyed as the flare roller 101 rotates, while the amount of toner that becomes attached to the flare roller 101 is regulated by a toner layer thickness regulating member 102, which in the example shown consists of an electrically conductive rubber blade. In another embodiment, the regulating member 102 may be in the form of a roller.

The limited amount of the toner is uniformly rearranged while it hops over the flare roller and is conveyed to the development region, where the latent image on the photosensitive member is developed in a contactless manner. The toner that is not used for development passed the development region and a toner leakage preventing member. The toner is eventually collected by the supply roller 103, which functions also as the collection roller, and is returned to the toner container portion.

In Example 1, the rectangular waves shown in FIG. 6B were used for causing the toner to hop over the flare roller surface. Specifically, the rectangular waves, with which the electrodes of the two phases on the flare roller 101 were fed, both had an average value V0 of −200 V, frequency f of 1 kHz, and a peak-to-peak voltage Vpp of 300 V.

To the toner layer thickness regulating member 102, a DC bias with the same value as the average value Vo of the bias applied to one phase of the electrodes, i.e., −200 V, was applied from a power supply PS 2.

When the duty of the rectangular wave bias is 50% as in the present example, the average value Vave of the bias applied to the flare roller 101 corresponds to the offset voltage V0 of the rectangular wave bias.

On the other hand, when the average value Vave of the bias applied to the flare roller 101 does not correspond to the offset voltage V0 for various reasons, such as that the duty is not 50%, for example, the average value Vave of the bias applied to the flare roller is applied to the toner layer thickness regulating member in order to make the toner layer thickness regulating member have the same potential.

Figure 8:
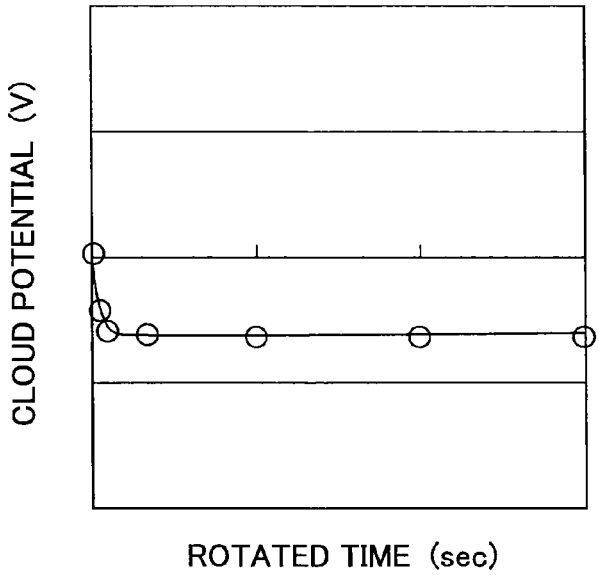
FIG. 8 shows a graph plotting a change in cloud potential in an example.

Under these conditions, when the flare roller 101 was continuously rotated in the developing unit 100 shown in FIG. 10, the amount of toner that attached to the flair roller 101 and the charge amount thereof after layer thickness regulation were constant. The cloud potential was also constant, as shown in FIG. 8.

The cloud potential refers to a surface potential on the flare roller 101 with the toner attached thereto while the flare bias is applied to cause the toner to hop.

When the cloud potential was constant, a constant potential difference could be maintained with respect to the latent image potential on the photosensitive member. Thus, the resultant image density was stable and there was no scumming, whereby good image formation was performed.

COMPARATIVE EXAMPLE

Figure 9:
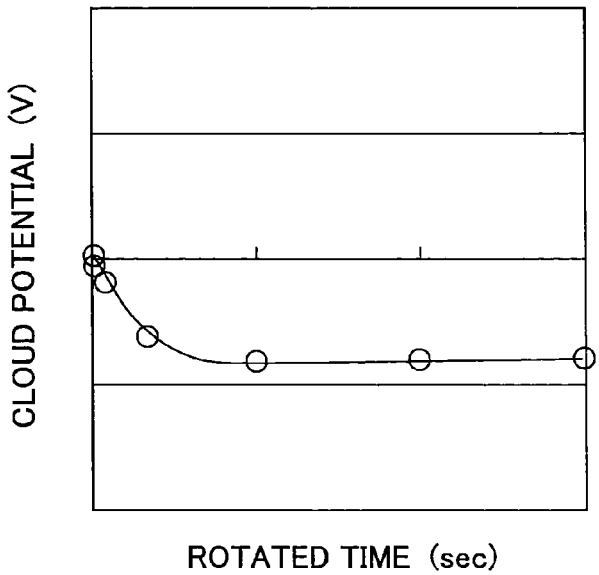
FIG. 9 shows a graph plotting a change in cloud potential in a comparative example.

Using the same configuration as that of Example 1, the same biases as those in Example 1 were applied to the flare roller 101, while −400 V was applied to the toner layer thickness regulating member 102. The potential kept decreasing as shown in FIG. 9 until 20 seconds after start of rotation of the roller. Because an appropriate development potential was not maintained in the development region, image density increased and scumming also developed.

Furthermore, because the substantial supply potential was smaller than at the initial point, the amount of toner supplied to the flare roller 101 was insufficient.

Thus, while an intended image was obtained immediately after the start of rotation of the flare roller 101 because the flare roller surface potential was zero at that point in time, the development potential, which is the difference between the surface potential and the latent image potential, increased as the surface potential on the photosensitive member increased in the negative direction, resulting in greater image density.

EXAMPLE 2

Figure 6A:
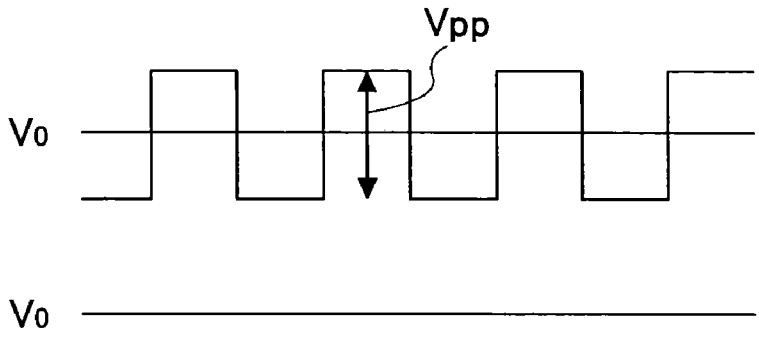
FIG. 6A shows waveforms of voltages applied to the electrodes in the flare roller shown in FIG. 3.
Figure 6B:
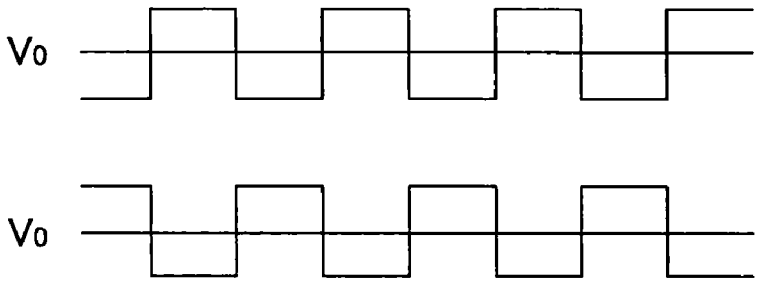
FIG. 6B shows another waveforms of voltages applied to the electrodes on the flare roller shown in FIG. 3.

In Example 2, a rectangular wave shown in FIG. 6A was used as the drive waveform for causing the toner to hop.

The rectangular wave for one phase had an average value V0 of −300 V, frequency f of 1 kHz, and a peak-to-peak voltage Vpp of 600 V. The bias for the other phase had a DC bias V0 of −300 V. Thus, a constant voltage was applied to one phase of electrodes, and the rectangular wave voltage was applied to the other phase of electrodes. In this case, too, it was possible to cause the toner to hop.

By thus using a DC bias as one of the biases applied to the flare roller 101, the number of power supply systems for producing pulses can be reduced by one, so that a power supply cost reduction can be achieved.

To the toner layer thickness regulating member 102, the DC bias of V0 was applied.

Thus, by equalizing the potential of the bias applied to the toner layer thickness regulating member and the average value of the biases applied to the flare roller 101, the flare roller surface potential could be maintained constant at all times, whereby a constant cloud potential was obtained when the flare roller was rotated continuously. Thus, good image formation was conducted without image density irregularities.

EXAMPLE 3

In Example 3, as the drive waveforms for causing the toner to hop, the rectangular waves shown in FIG. 6B were used. Specifically, the rectangular waves of opposite phases with an average value V0 of −300 V, frequency f of 1 kHz, and a peak-to-peak voltage Vpp of 300 V, were applied.

To the toner layer thickness regulating member 102, a rectangular wave bias with an average value V0 of −300 V, frequency f2 of 500 Hz, and a peak-to-peak voltage V2 of 400 V was applied.

Under these conditions, when the flare roller 101 was continuously rotated, a constant cloud potential was obtained. Thus, good image formation was conducted without image density irregularities.

EXAMPLE 4

In Example 4, the same drive waveforms as in Example 3 were applied as flare biases. To the toner layer thickness regulating member 102, the same waveform as either one of the rectangular waves applied to the flare roller, i.e., phase A or B, was applied.

Under these conditions, when the flare roller 101 was continuously rotated, a constant cloud potential was obtained. Thus, good image formation was conducted without image density irregularities.

EXAMPLE 5

In Example 5, as the drive waveform for causing the toner to hop, the rectangular wave shown in FIG. 6A was used. Namely, the rectangular wave for one phase had the average value V0 of −300 V, frequency f of 1 kHz, and the peak-to-peak voltage Vpp of 600 V. The bias for the other phase had the DC bias V0 of −300 V.

The bias applied to the toner layer thickness regulating member was the same rectangular wave bias applied to one of the phases of the flare roller 101.

Under these conditions, when the flare roller 101 was continuously rotated, a constant cloud potential was obtained. Thus, good image formation was conducted without image density irregularities.

Finally, the mechanism by which the surface potential of the flare roller 101 fluctuates in the absence of an appropriate voltage applied to the toner layer thickness regulating member as in the above examples is discussed.

A study conducted by the present inventors revealed that there are three causes for the fluctuation in the flare roller surface potential as described below.

Figure 11:
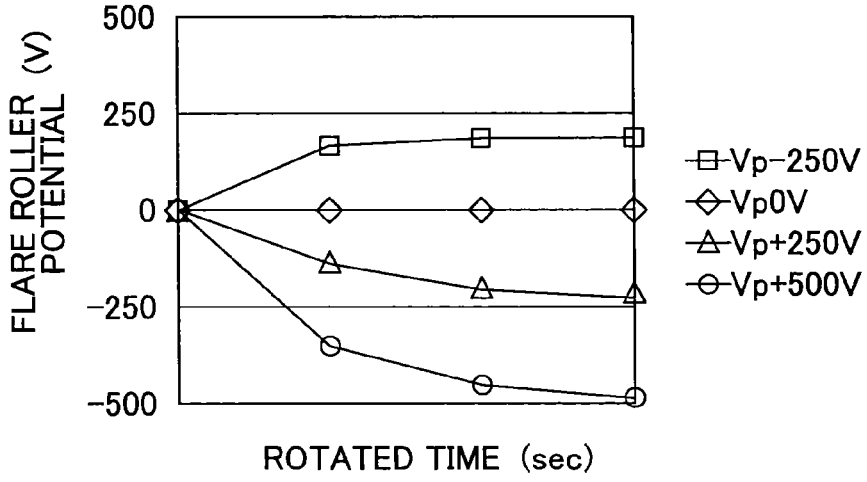
FIG. 11 shows the result of measuring changes in the surface potential of a flare roller with time when the supply roller and the flare roller alone were rotated idly.
Figure 12:
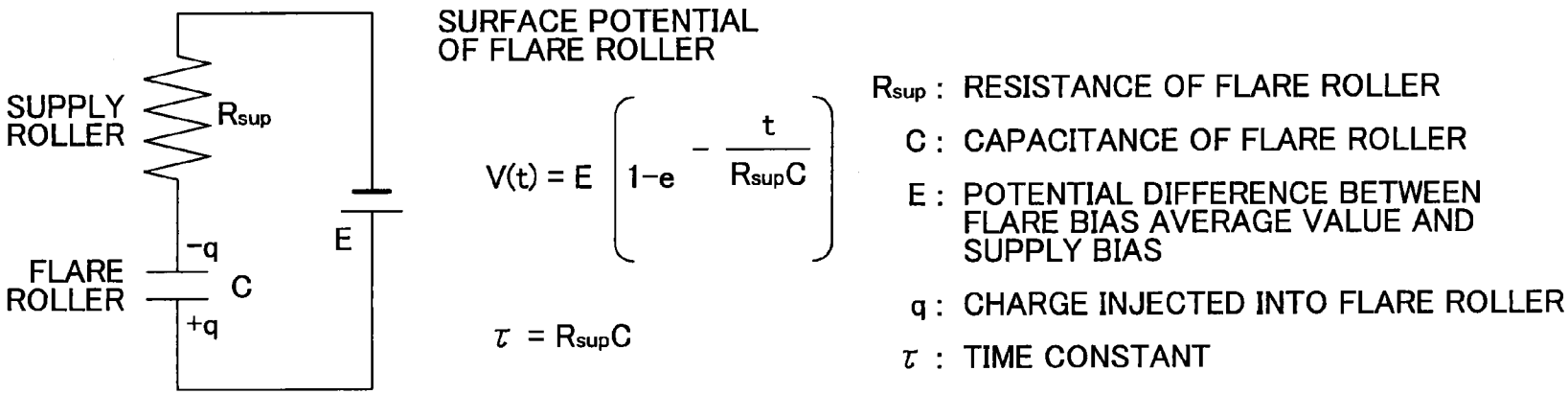
FIG. 12 shows an RC series circuit for describing an electric analysis of a flare roller according to an embodiment of the present invention.

(1) Accumulation of Charge Based on a Capacitance Model (see FIGS. 11 and 12)

In order to evaluate the influence of the supply roller 103 and the flare roller 101 alone without intervention from the toner, the supply roller 103 and the flare roller 101 alone were rotated idly, and the temporal shift in surface potential of the flare roller 101 was measured. The result is shown in FIG. 11. The illustrated behaviors correspond to the surface potential of a capacitor of an RC series circuit shown in FIG. 12 due to the charge accumulated in the capacitor.

Namely, charge accumulates in the surface protection layer of the flare roller 101 until there is no potential difference between the supply roller 103 and the flare roller surface potential, whereupon the potential saturates. The charge is gradually lost by turning off the power supply for the supply roller bias and flare roller bias. However, because the surface protection layer has a high resistance in order to insulate the electrodes from each other, the charge that has once accumulated does not easily leak when left to stand. Thus, it is considered difficult to construct a complete system without providing a neutralizing unit.

Figure 13:
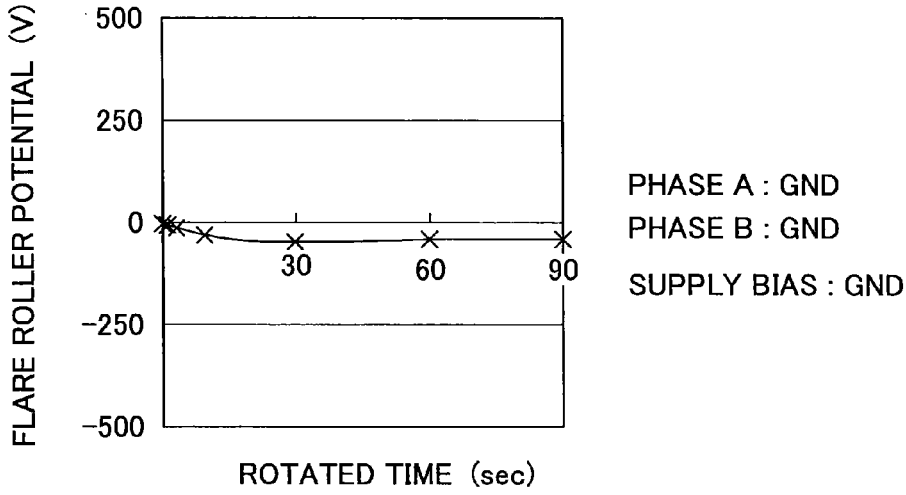
FIG. 13 shows the result of measuring a change in the flare roller surface potential with time by connecting both a supply roller bias and biases to the two phases of electrodes in the flare roller to ground.

(2) Triboelectric Charging Between the Flare Roller and the Supply Roller (see FIG. 13)

In order to examine the triboelectric characteristics alone between the supply roller 103 and the flare roller 101 by further eliminating the influences of the bias applied to the supply roller 103 and the bias applied to the flare roller 101, the supply bias and the biases for the two phases applied to the flare roller 101 were all connected to ground, and the temporal change in the flare roller surface potential was similarly measured. The result is shown in FIG. 13. Based on the observed behaviors, it was learned that the flare roller 101 is charged with approximately −40V by the triboelectric charging between the flare roller 101 and the supply roller 103 alone. This value and the rate of convergence are influenced by the relationship between the materials of the supply roller 103 and the flare roller surface protection layer in terms of the triboelectric series, and by the degree of engagement of the supply roller 103.

Figure 14:
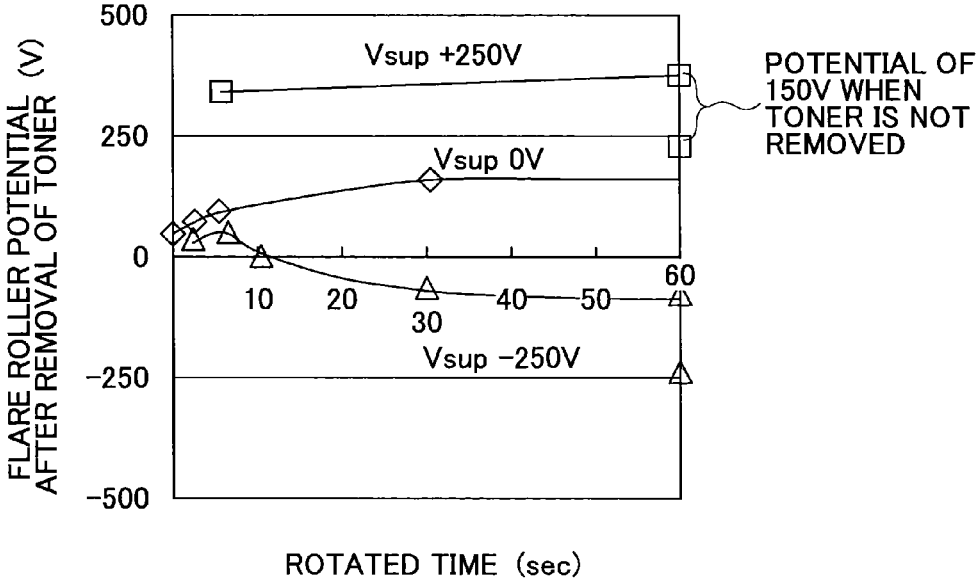
FIG. 14 shows a graph for describing one of the factors causing fluctuation in flare roller surface potential.

(3) Induced Charge that Cancels the Negative Charge of Toner (see FIG. 14)

When the toner supplied from the supply roller 103 hops over the flare roller 101, a positive charge is induced in the flare roller surface protection layer. When the flare roller surface potential is measured after removal of the toner, a positive surface potential is present. The larger the amount of charge in the toner, the greater is the value of the positive surface charge.

With the first model alone, the fluctuation in the surface potential based on the capacitance model can be avoided by relying solely on a mechanical scraping of the toner for its supply and collection without using any electric field.

However, because the surface potential is simultaneously charged based on the second and third models, neutralization is required in order to convey the toner to the region opposite the photosensitive member 1 with a constant flare roller surface potential at all times.

In the foregoing description, plural image forming units are disposed with respect to a single photosensitive member belt in the image forming apparatus, as shown in FIG. 1. The present invention, however, is not limited to such an embodiment. In another embodiment, a photosensitive member, a charging device, a developing unit, and/or a cleaning device may be contained in a process cartridge for an individual color. An image formed by each process cartridge for an individual color may be successively transferred onto an intermediate transfer unit such as a transfer belt or onto a recording medium and superposed thereon, whereby a multicolor image can be formed.

Figure 15:
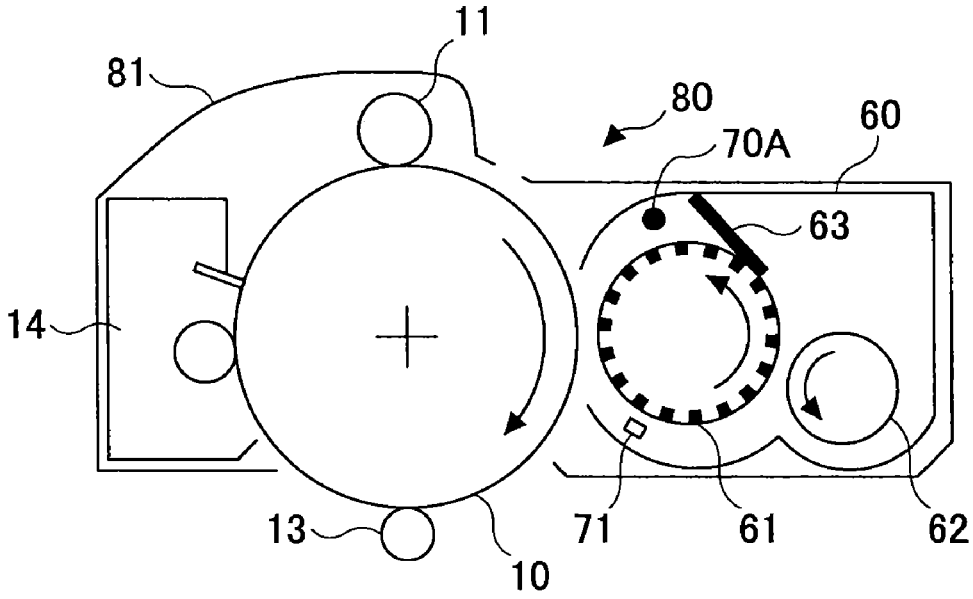
FIG. 15 shows a cross section of a process cartridge according to an embodiment of the invention.

FIG. 15 shows a cross section of a process cartridge according to an embodiment of the invention. The process cartridge 80 includes a photosensitive member 10, a charging device 11, a developing unit 60, and a cleaning device 14, all of which are contained within a cartridge body 81. The developing unit 60 includes a flare roller 61, a supply roller 62, a toner layer thickness regulating member 63, a toner attachment preventing member 70A, and an attached-toner-amount detecting unit 71.

Because the process cartridge 80 can be detachably attached to an image forming apparatus, the process cartridge 80 can be readily exchanged or recycled, thus contributing to the improvement in ease of maintenance of the image forming apparatus or saving of resources.

Figure 16:
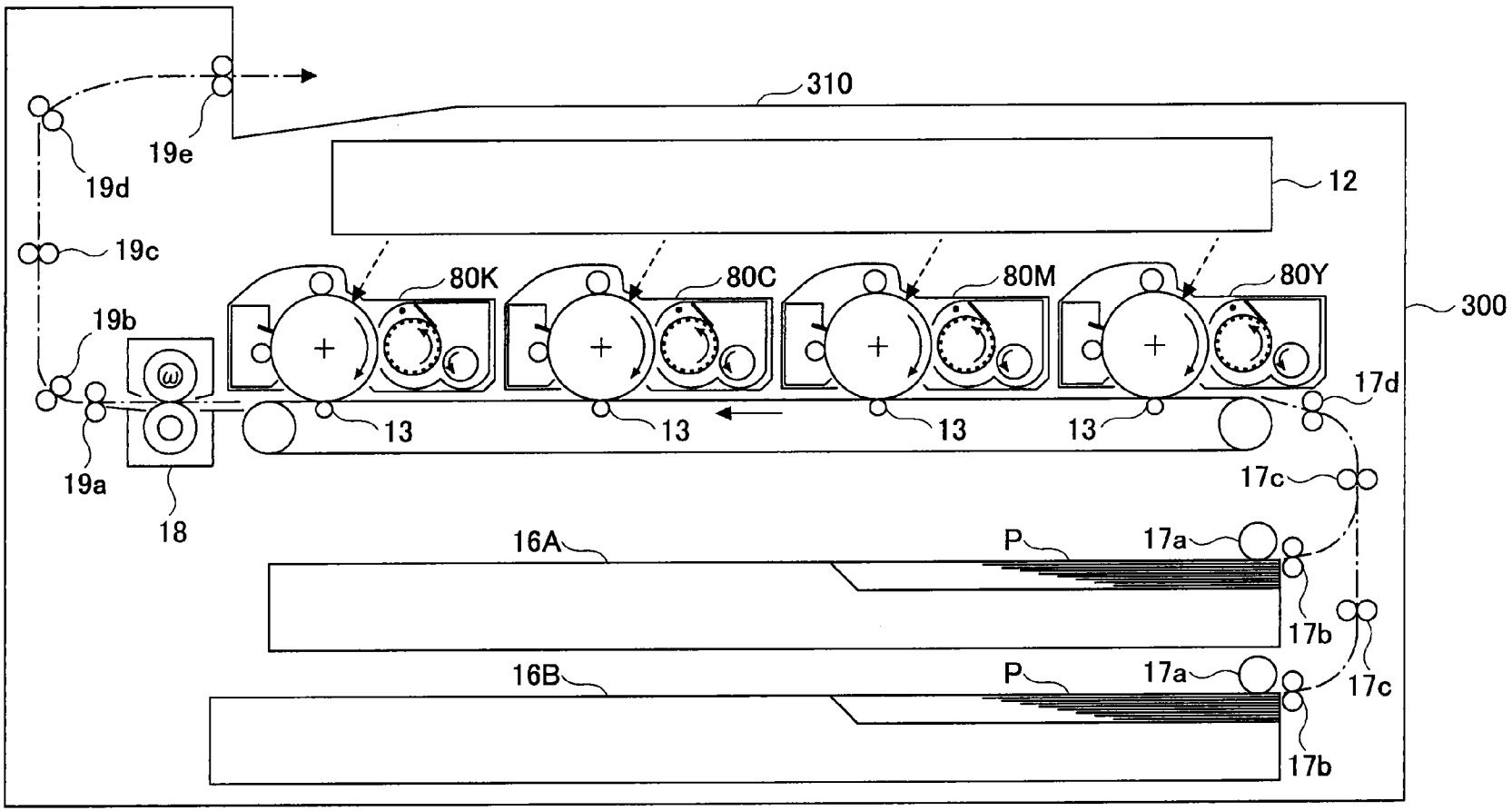
FIG. 16 shows a color image forming apparatus according to another embodiment of the invention.

FIG. 16 shows a color image forming apparatus 300 according to another embodiment of the invention. The color image forming apparatus 300 includes a plurality of the process cartridges 80 shown in FIG. 15 for forming a single-color, a multicolor, or a full-color image.

In the color image forming apparatus 300, four process cartridges 80Y, 80M, 80C, and 80K are arranged along a transfer belt 90 for transporting a recording sheet P. The process cartridge 80Y is configured to form a yellow toner image on the photosensitive member by electrophotographic process. The process cartridge 80M is configured to form a magenta toner image on the photosensitive member by electrophotographic process. The process cartridge 80C is configured to form a magenta toner image on the photosensitive member by electrophotographic process. The process cartridge 80K is configured to form a black toner image on the photosensitive member by electrophotographic process.

Under the transfer belt 90, paper cassettes 16A and 16B stocked with recording sheets P, such as sheets of paper, are disposed in stages. From either the paper cassette 16A or 16B, the recording sheet P is fed by a feed roller 17*a* and a separating roller 17*b* one sheet at a time in step with the image forming timing of the individual process cartridges 80Y, 80M, 80C, and 80K. The recording sheet P passes through plural transport rollers 17*c* and is delivered to a resist roller 17*d*. The resist roller 17*d* sends the recording sheet P onto the transfer belt 90 in step with the timing of the toner image on the photosensitive member in each of the process cartridges 80Y, 80M, 80C, and 80K arriving at the transfer position. The recording sheet P is then transported by the transfer belt 90 to the transfer position of each of the process cartridges 80Y, 80M, 80C, and 80K successively, while the toner image of the individual color on each photosensitive member is transferred to the recording material by each transfer device 13 successively, one color upon another. The recording sheet P with the transferred toner image is further transported by the transport belt 90 to a fusing device 18, where the toner image is fixed to the recording sheet P by the fusing device 18 through heating or pressing. The recording sheet after fusing passes through plural ejection rollers 19*a*-19*e* and is ejected onto a catch tray 310. The photosensitive member 10 in each of the process cartridges 80Y, 80M, 80C, and 80K after toner image transfer is cleaned by a cleaning device 14 to remove remaining toner.

Thus, in the color image forming apparatus 300, the individual process cartridges 80Y, 80M, 80C, and 80K are selectively driven, whereby a stable single-color, multicolor, or full-color image can be formed. Because the process cartridges 80Y, 80M, 80C, and 80K are detachably provided in the image forming apparatus 300, the cartridges can be readily exchanged or recycled, thus contributing to the improvement in ease of maintenance of the image forming apparatus 300 or saving of resources. Thus, the color image forming apparatus 300 is easy to maintain and manage.

It is to be understood that the above-described embodiments are merely illustrative of some of the many specific embodiments that represent applications of the principles of the present invention. Clearly, numerous and other arrangements can be readily devised by those skilled in the art without departing from the scope of the invention.

For example, the bias voltages applied to the electrodes of the flare roller and to the toner layer thickness regulating member may be provided by the same power supply.

The present application is based on the Japanese Priority Application No. 2007-200079 filed Jul. 7, 2007, the entire contents of which are hereby incorporated by reference.

What is claimed is:

1. A developing apparatus comprising:

a toner carrier having plural electrodes disposed at predetermined intervals;

a first voltage supply unit configured to apply a bias voltage to the electrodes of the toner carrier in order to generate an electric field between the electrodes that varies with time, wherein toner carried on the surface of the toner carrier is caused to hop by the electric field between the electrodes, forming a cloud of toner so that the toner attaches to a latent image formed on a latent image carrier which is disposed opposite the toner carrier, thereby developing the latent image;

a toner layer thickness regulating member configured to regulate the amount of the toner that is carried on the toner carrier; and a second voltage supply unit configured to apply a bias voltage to the toner layer thickness regulating member, wherein the bias voltage applied to the toner layer thickness regulating member has an average value that is equal to an average value of the bias voltage applied to the electrodes of the toner carrier by the first voltage supply unit.

2. The developing apparatus according to claim 1, wherein the bias voltage applied to the electrodes of the toner carrier includes a bias voltage having a waveform that varies with time that is applied to one group of the electrodes, and another bias voltage having a waveform that varies with time with an opposite phase that is applied to another group of the electrodes, wherein the bias voltage applied to the toner layer thickness regulating member is a DC bias voltage.

3. The developing apparatus according to claim 1, wherein the bias voltage applied to the electrodes of the toner carrier includes a bias voltage having a waveform that varies with time that is applied to one group of the electrodes, and a DC bias voltage that is applied to another group of the electrodes, wherein the bias voltage applied to the toner layer thickness regulating member is a DC bias voltage.

4. The developing apparatus according to claim 1, wherein the bias voltage applied to the electrodes of the toner carrier includes a bias voltage having a waveform that varies with time that is applied to one group of the electrodes, and a bias voltage having a waveform that varies with time with an opposite phase that is applied to another group of the electrodes, wherein the bias voltage applied to the toner layer thickness regulating member has a waveform that varies with time.

5. The developing apparatus according to claim 4, wherein the bias voltage applied to the toner layer thickness regulating member is equal to the bias voltage applied to the one group of the electrodes of the toner carrier.

6. The developing apparatus according to claim 1, wherein the bias voltage applied to the electrodes of the toner carrier includes a bias voltage having a waveform that varies with time that is applied to one group of the electrodes, and a DC bias voltage applied to another group of the electrodes, wherein the bias voltage applied to the toner layer thickness regulating member has the same waveform as the waveform of the bias voltage applied to the one group of the electrodes of the toner carrier.

7. The developing apparatus according to claim 1, wherein the toner layer thickness regulating member has electrical conductivity.

8. The developing apparatus according to claim 1, wherein the second voltage supply unit is configured to supply the bias voltage to the toner layer thickness regulating member which is equal to the bias voltage applied to the electrodes of the toner carrier.

9. The developing apparatus according to claim 1, wherein the first voltage supply unit is configured to supply the bias voltage to the electrodes of the toner carrier which includes a bias voltage having a waveform that varies with time, and wherein the second voltage supply unit is configured to supply the bias voltage to the toner layer thickness regulating member which is equal to the bias voltage applied to the electrodes of the toner carrier.

10. The developing apparatus according to claim 1, wherein the electrodes include a first group of electrodes to which a first bias voltage is applied and a second group of electrodes to which a second bias voltage is applied, wherein the first group of electrodes and the second group of electrodes are alternately disposed on the toner carrier.

11. An image forming apparatus comprising:

a latent image carrier on which a latent image is carried;

a developing unit including:

a toner carrier having plural electrodes disposed at predetermined intervals;

a first voltage supply unit configured to apply a bias voltage to the electrodes of the toner carrier in order to generate an electric field between the electrodes that varies with time, wherein toner carried on the surface of the toner carrier is caused to hop by the electric field between the electrodes, forming a cloud of toner so that the toner attaches to a latent image formed on a latent image carrier which is disposed opposite the toner carrier, thereby developing the latent image;

a toner layer thickness regulating member configured to regulate the amount of the toner that is carried on the toner carrier; and a second voltage supply unit configured to apply a bias voltage to the toner layer thickness regulating member, wherein the bias voltage applied to the toner layer thickness regulating member has an average value that is equal to an average value of the bias voltage applied to the electrodes of the toner carrier by the first voltage supply unit, an image transfer unit; and a recording medium;

wherein the latent image carried on the latent image carrier is developed by causing the toner on the toner carrier in the developing unit to become attached to the latent image, wherein the developed image is transferred onto the recording medium by the image transfer unit.

12. The image forming apparatus according to claim 11, further comprising:

at least one more of said developing units, wherein each of the developing units is configured to develop the latent image on the latent image carrier with a toner of a separate color so that a multicolor image can be formed on the latent image carrier.

13. The image forming apparatus according to claim 11, wherein the second voltage supply unit is configured to supply the bias voltage to the toner layer thickness regulating member which is equal to the bias voltage applied to the electrodes of the toner carrier.

14. The image forming apparatus according to claim 11, wherein the first voltage supply unit is configured to supply the bias voltage to the electrodes of the toner carrier which includes a bias voltage having a waveform that varies with time, and wherein the second voltage supply unit is configured to supply the bias voltage to the toner layer thickness regulating member which is equal to the bias voltage applied to the electrodes of the toner carrier.

15. The image forming apparatus according to claim 11, wherein the electrodes include a first group of electrodes to which a first bias voltage is applied and a second group of electrodes to which a second bias voltage is applied, wherein the first group of electrodes and the second group of electrodes are alternately disposed on the toner carrier.

16. A process cartridge comprising:

a developing apparatus including:

a toner carrier having plural electrodes disposed at predetermined intervals;

a first voltage supply unit configured to apply a bias voltage to the electrodes of the toner carrier in order to generate an electric field between the electrodes that varies with time, wherein toner carried on the surface of the toner carrier is caused to hop by the electric field between the electrodes, forming a cloud of toner so that the toner attaches to a latent image formed on a latent image carrier which is disposed opposite the toner carrier, thereby developing the latent image;

a toner layer thickness regulating member configured to regulate the amount of the toner that is carried on the toner carrier; and a second voltage supply unit configured to apply a bias voltage to the toner layer thickness regulating member, wherein the bias voltage applied to the toner layer thickness regulating member has an average value that is equal to an average value of the bias voltage applied to the electrodes of the toner carrier by the first voltage supply unit; and at least one of a latent image carrier on which a latent image is carried, a charging unit configured to charge the latent image, and a cleaning unit configured to remove the toner that remains on the latent image carrier after the latent image on the image carrier is developed and transferred to a recording medium.

17. The process cartridge according to claim 16, wherein the developing apparatus is configured to develop the latent image on the latent image carrier with a toner of an individual color so that a multicolor image can be formed on the recording medium by a plurality of the process cartridges used in combination.

18. The process cartridge according to claim 16, wherein the second voltage supply unit is configured to supply the bias voltage to the toner layer thickness regulating member which is equal to the bias voltage applied to the electrodes of the toner carrier.

19. The process cartridge according to claim 16, wherein the first voltage supply unit is configured to supply the bias voltage to the electrodes of the toner carrier which includes a bias voltage having a waveform that varies with time, and wherein the second voltage supply unit is configured to supply the bias voltage to the toner layer thickness regulating member which is equal to the bias voltage applied to the electrodes of the toner carrier.

20. The process cartridge according to claim 16, wherein the electrodes include a first group of electrodes to which a first bias voltage is applied and a second group of electrodes to which a second bias voltage is applied, wherein the first group of electrodes and the second group of electrodes are alternately disposed on the toner carrier.

* * * * *